US006276615B1

(12) United States Patent
Scholz

(10) Patent No.: US 6,276,615 B1
(45) Date of Patent: Aug. 21, 2001

(54) INJECTOR FOR SPRAYING CATALYST BEDS

(75) Inventor: Norbert Scholz, Hassloch (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/157,617

(22) Filed: Sep. 21, 1998

(30) Foreign Application Priority Data

Sep. 22, 1997 (DE) ..... 197 41 752

(51) Int. Cl.[7] ..... B05B 7/06

(52) U.S. Cl. ..... 239/424; 239/419; 239/553; 239/567; 239/600; 422/140

(58) Field of Search ..... 239/418, 419, 239/419.3, 423, 424, 548, 549, 553, 553.5, 558, 559, 567, 336, 371, 600; 422/140

(56) References Cited

U.S. PATENT DOCUMENTS

| | | | | |
|---|---|---|---|---|
| 4,518,120 | | 5/1985 | Johnson . | |
| 4,674,682 | * | 6/1987 | Hansson | 239/424 X |
| 4,890,793 | * | 1/1990 | Fuglistaller et al. | 239/424 X |
| 5,271,562 | * | 12/1993 | Myers et al. | 239/424 X |
| 6,027,332 | * | 2/2000 | Glotin et al. | 239/419.3 X |

FOREIGN PATENT DOCUMENTS

| | | |
|---|---|---|
| 195 26 404 | 1/1997 | (DE) . |
| 1460927 | 10/1966 | (FR) . |
| 2 641 365 | 7/1990 | (FR) . |

OTHER PUBLICATIONS

Thomas Richter, et al., "Kalkulierter Spruh—Methoden des Zerstaubens von Flussigkeiten in der Verfahrenstechnik," Maschinenmarkt, Wurzburg 97 (1991) 11, pp. 26–28, 30–31. (with English Abstract).

* cited by examiner

*Primary Examiner*—David A. Scherbel
*Assistant Examiner*—Steven J. Ganey
(74) *Attorney, Agent, or Firm*—Oblon, Spivak, McClelland, Maier & Neustadt, P.C.

(57) ABSTRACT

An injector for uniformly distributing solids or liquids over surfaces. The injector includes at least two individual injectors each having an internal guide element and an external guide element. The injector includes a double jacketed tube with an inner tube and an outer tube. The injector includes a base body connected to the tubes of the double jacketed tube, and connecting the inner tube to the internal guide element and a region between the inner and outer tubes to the external guide element. The base body and the injectors are arranged such that a mixture of carrier gas and solid particles or liquid droplets which is supplied through the inner tube and a propellent gas which is supplied through the region lead to a turbulent flow mixture of propellent gas, carrier gas and solid particles or liquid droplets and to the turbulent flow mixture formed being distributed radially and uniformly.

9 Claims, 1 Drawing Sheet

INJECTOR FOR SPRAYING CATALYST BEDS

Figure 1:
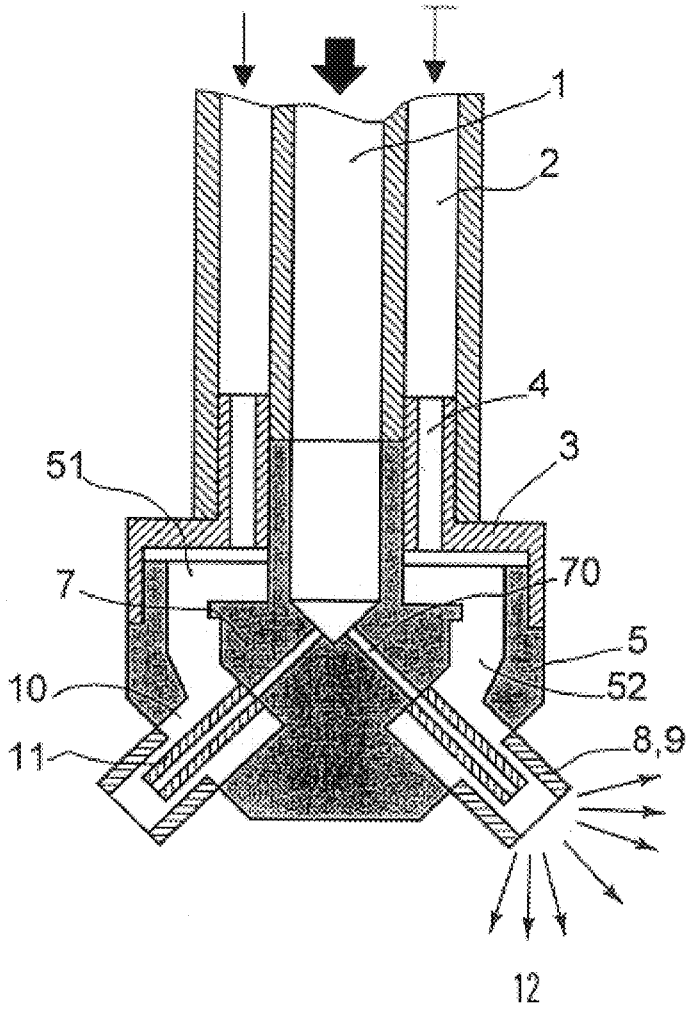

The invention relates to injectors and in particular to two-substance injectors. The invention furthermore relates to the use of such injectors for spraying catalyst beds.

In the prior art, there are numerous publications which relate to the atomization of liquids. In particular, two-substance nozzles with internal mixing and two-substance nozzles with external mixing have been described and examined theoretically and by experimentation. The article "Kalkulierter Sprüh—Methoden des Zerstäubens von Flüssigkeiten in der Verfahrenstechnik" [Calculated spray—methods of liquid atomization in process technology] by Thomas Richter and Stefan Wilhelm (Maschinenmarkt 1991, pp. 26 ff.) has described such atomization nozzles.

In DE-A-195 26 404 a device for distributing a first medium using a second medium has been described. The description mentions a very low ratio between the outlet surface areas of the respective orifices for the second medium and those of the orifices for the outlet of the first medium.

Although, furthermore, commercial suppliers in the prior art offer numerous spray heads for atomizing a very wide variety of materials, so far there is no spray head or injector available which fulfills the following combination of requirements:

- the injector requires little space at the installation site,
- the injector is able to withstand high temperatures,
- the injector brings about a uniform, surface-covering distribution of small quantities of solids over large surface areas,
- the injector is of simple construction,
- the injector is secure against faults during operation even with solid aerosols.

Particularly when promoting silver catalysts, as are used in the production of formaldehyde, there has been a need for a uniform, pulsed doping of the catalyst with the promoter during operation of the reactor and under the turbulent flow conditions present in the reactor. The intention is to avoid local excess metering of promoter, which can lead to deactivation of the catalyst. Conventional nozzles for supplying promoters do not allow this to be achieved.

The object of the invention is therefore to provide an injector which avoids the drawbacks of the prior art and fulfills the abovementioned requirements. In particular, the intention is for this injector to be suitable for use in the promotion of a silver catalyst where there is a large catalyst surface area. Furthermore, it is intended for it to be possible to integrate the injector in existing lock systems in formaldehyde reactors.

The object is achieved by means of an injector which is suitable for uniformly distributing solids or liquids over large surfaces and has at least two individual injectors. According to the invention, the injector contains a double jacketed tube and a base body for individual injectors. The double jacketed tube has an inner tube, which is suitable for guiding a mixture of carrier gas and solid particles or liquid droplets, and an outer tube which is suitable for guiding a propellant gas. The base body is tightly connected to the two tubes of the double jacketed tube. The base body has connecting orifices, which form a connection between the interior of the inner tube and in each case one connection point for an internal guide element of an individual injector, and connecting passages, which form a connection between the region between the inner tube and the outer tube of the double jacketed tube and in each case one connection point for an external guide element, which surrounds the internal guide element, of an individual injector. Base body and individual injectors are designed and arranged in such a way that a mixture of carrier gas and solid particles or liquid droplets which is supplied through the inner tube and a propellant gas which is supplied through the region between the inner tube and the outer tube lead to a turbulent flow of propellant gas, carrier gas and solid particles or liquid droplets and to the mixture formed being distributed radially and uniformly.

Surprisingly, it has been found that injectors with nozzles which are fed simultaneously by a propellant gas and a distribution gas make it possible to distribute a solid promoter finely with virtually no possibility of local excess metering over the catalyst. Advantageously, the nozzles and the injector are furthermore of simple construction, are operationally reliable during use and are designed in such a way that the injector can be adapted to existing conditions of flow. The injector can be integrated in particular in an existing lock system of a formaldehyde reactor.

In one embodiment of the invention, a connection element is present between base body and double jacketed tube, the connection element having bores which are arranged in the form of a ring for conveying and uniformly distributing the propellant gas and which are dimensioned in such a way that the pressure drop when flowing through is lower by a multiple than when flowing into the pressure chamber of the individual injector.

Advantageously, an annular distributor chamber, which is connected to the region between the inner tube and the outer tube of the double jacketed tube, may be present in the base body. Connecting passages lead from this chamber to in each case one connection point for an external guide element of an individual injector.

Preferably, three to eight individual injectors are arranged in a regular polygon and connected to the base body.

Successful results are achieved with injectors according to the invention in which the individual injectors are designed as two-substance annular injectors.

It may be expedient to design and arrange the external guide element of the individual injectors in such a way that the propellant gas, on coming into contact with the mixture of carrier gas and solid particles or liquid droplets, has a flow component which is tangential with respect to the axis of the individual injector in question.

The fact that the individual injectors are connected in groups to a plurality of, in particular two, injector levels on the base body makes it possible to achieve particularly suitable distribution of the material.

The injector according to the invention may be designed in such a way that the central spraying direction of the individual injectors has only a radial and an axial component with respect to the axis of the double jacketed tube.

If a centrifugal distribution component is desired, the central spraying direction of the individual injectors may have a component which is tangential with respect to the axis of the double jacketed tube.

The invention furthermore relates to a method for supplying a suspension to a catalyst bed, in particular one which has a large surface area, wherein an injector according to the invention is used. By way of example, the catalyst bed may have minimum linear dimensions of 0.5–3 m, preferably in essentially circular form. The injector according to the invention is particularly suitable for supplying promoter material, in particular phosphorus promoter material, to a catalyst bed, in particular a silver catalyst bed, as is used in particular in a formaldehyde reactor.

The injector according to the invention can be used to distribute small quantities of solids, in particular 0.1–10 $g/m^2$, preferably 0.1–5 $g/m^2$, uniformly over large surface areas.

Figure 2:
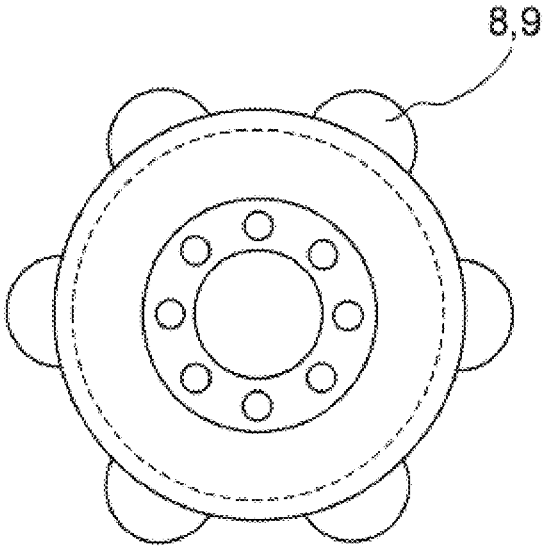

Further details, features and advantages of the invention will emerge from the following description and the drawing, in which FIG. 1 shows a cross section through an injector according to the invention, and FIG. 2 shows a plan view of an injector according to the invention.

FIG. 1 shows a preferred injector according to the invention which is of modular design. The product feed, base body and annular injector modules are easy to alter in terms of their design and efficacy. The individual elements are easily exchangeable by means of plug and/or screw connections. The injector according to the invention has a double jacketed tube 1, 2, which comprises an inner tube 1 and an outer tube 2. The double jacketed tube is connected to a base body 5 via an intermediate piece 3, which preferably has three to twelve, and in the case illustrated eight, connecting bores 4 which run in the axial direction with regard to the double jacketed tube. An annular distributor chamber 51 is provided in this base body, from which chamber connecting passages, in the form of bores 52, lead to propellant-gas annular chambers 10 of individual injectors 8, 9, 10, 11.

Connecting orifices, in the form of bores 70, lead radially outward and axially downward through an internal section of the base body. The bores 70 connect the interior of the inner tube to spray nozzles 11 of the individual injectors 8, 9, 10, 11. The spray nozzles (internal guide elements) 11 are surrounded by external guide cylinders 8, 9. These cylinders (external guide elements) may, for example, be screwed into the base body 5.

The individual injectors, six of which are shown in FIG. 2, may be configured in such a way that a component of the propellant gas flow which is tangential with respect to the central spraying direction (as evidenced by reference numeral 12 in FIG. 1) or the axis of the individual injectors is generated. This may preferably be effected by means of the design of the external guide cylinders 8, 9, e.g. by the shape of their walls. The individual injectors themselves may furthermore be arranged in such a way that they have an outlet component which is tangential with regard to the axis of the double jacketed tube.

In operation, an aerosol flow, preferably finely dispersed solid material, in a carrier gas is supplied to the spray nozzles 11 of the individual injectors through the inner tube 1 and the bores 70. At the same time, the propellant gas flow is supplied, via the annular region between the inner tube 1 and the outer tube 2, through the bores 4, the distributor chamber 51, the bores 52 and the supply chambers 10 of the individual injectors, in such a way that a strong turbulent flow and mixing of the aerosol flow and of the propellant gas flow are produced in the interior of the individual injectors.

Typical operating conditions for the propellant gas flow, which preferably consists of air, are pressures of from 0.5 to 5 bar, while the aerosol, i.e. the particles or droplets in an inert gas or compressed air, is preferably supplied to the nozzle head or injector head at a pressure of from 0.2 to 3.0 bar. Operating the injector in this way results in a very uniform distribution of solid material, in particular phosphorus doping material, over a catalyst bed, for example. Combining the aerosol and propellant gas leads to optimum atomization and distribution.

The invention, as well as preferred specific features thereof, is explained below with reference to examples.

EXAMPLE 1 (COMPARATIVE EXAMPLE)

A three-layered silver catalyst bed having a total layer thickness of 2 cm was arranged in a production reactor. The bottom layer consisted of silver crystals having a particle size of 1 to 2.5 mm, the middle layer consisted of silver crystals having a particle size of 0.75 to 1 mm, and the top layer consisted of silver crystals having a particle size of 0.2 to 0.75 mm.

A gas mixture comprising methane, water and air was guided through an initial silver catalyst fixed bed which had been heated to 340° C. During the 2-hour activation period, the volume was increased to 4.5 to methanol, 3.1 to water and 7.8 to air per hour (final load). At the end of the activation period the temperature in the fixed bed was 680° C. This volumetric flow was kept constant throughout the entire duration of the test. Then, a conventional injector was used to spray 180 mg of phosphorus per $m^2$ of cross-sectional area of the activated silver catalyst fixed bed in the form of pulverulent $Na_4P_2O_7$, while the feed of the gas mixture was continued. The operation of the reactor proceeded continuously and after waiting for a number of hours further quantities of phosphorus were applied to the phosphorus-doped silver catalyst fixed bed.

After the fifth additional injection of phosphorus, the catalyst bed became partially deactivated, which was reflected, inter alia, in the increasing methanol content in the end product and in a lower process yield.

The result of this example is summarized below:

| Result 1 | |
|---|---|
| Before the final spraying | |
| Conversion | 97.3% |
| Selectivity | 92.6% |
| Yield | 90.1% |
| Residual methanol in the product | 3.2% (based on 100% formaldehyde) |
| After the final spraying | |
| Conversion | 93.0% |
| Selectivity | 90.6% |
| Yield | 84.2% |
| Residual methanol in the product | 8.9% (based on 100% formaldehyde) |

The deactivation of the catalyst was visually perceptible via camera monitoring as a resulting dark spot on the catalyst surface.

Example 2

Example 1 was repeated, but the phosphorus was supplied using an injector according to the present invention. Operation of the reactor proceeded continuously, and after waiting for a number of hours further quantities of phosphorus were applied to the phosphorus-doped silver catalyst fixed bed. In total, phosphorus was resprayed 112 times within a period of 49 days without the catalyst bed becoming deactivated.

Result:

On the 31st day after starting the spraying, following the 44th spraying operation:

| | |
|---|---|
| Conversion | 97.3% |
| Selectivity | 92.7% |

-continued

| | |
|---|---|
| Yield | 90.2% |
| Residual methanol in the product | 3.2% (based on 100% formaldehyde) |
| On the 36th day after starting the spraying, following the 56th spraying operation | |
| Conversion | 97.2% |
| Selectivity | 92.9% |
| Yield | 90.3% |
| Residual methanol in the product | 3.3% (based on 100% formaldehyde) |

Example 3

Example 1 was repeated, but the injector according to the invention was used to spray 180 mg of phosphorus per $m^2$ of the activated silver catalyst fixed bed, in the form of a 2.0 wt % strength aqueous solution of $Na_4P_2O_7$, onto the surface of said catalyst bed, while the feed of the gas mixture was continued.

In total, phosphorus was resprayed 67 times within a period of 35 days without the catalyst becoming deactivated.

Result

| On the 11th day after starting the spraying, following the 18th spraying operation | |
|---|---|
| Conversion | 96.7% |
| Selectivity | 93.2% |
| Yield | 90.1% |
| Residual methanol in the product | 3.9% |

EXAMPLE 4 (COMPARATIVE EXAMPLE)

Example 1 was repeated, but in this case a conventional injector was used to spray 270 mg of phosphorus per $m^2$ of the cross-sectional area of the activated silver catalyst fixed bed, in the form of a 0.3 wt % strength aqueous solution of $Na_4P_2O_7$, onto the surface of said catalyst bed, while the feed of the gas mixture was continued.

In total, phosphorus was resprayed 16 times within a period of 30 days, with only a limited conversion being achieved following the 10th subsequent spraying. It was possible to correct the impaired conversion again by lowering the reactor throughput, but the problem arose again with each subsequent spraying operation, until correction was no longer possible after the 16th occurrence. This negative result using the conventional injector is summarized below:

| Result 4 | |
|---|---|
| Before the final spraying | |
| Conversion | 97.0% |
| Selectivity | 92.4% |
| Yield | 89.5% |
| Residual methanol in the product | 3.6% (based on 100% formaldehyde) |

-continued

| Result 4 | |
|---|---|
| After the last spraying | |
| Conversion | 71.2% |
| Selectivity | 93.3% |
| Yield | 66.5% |
| Residual methanol in the product | 46.2% (based on 100% formaldehyde) |

What is claimed is:

1. An injector suitable for uniformly distributing solids or liquids over surfaces, said injector comprising:

at least two individual injectors each having an internal guide element and an external guide element;

a double jacketed tube with an inner tube, which is suitable for guiding a mixture of carrier gas and solid particles or liquid droplets, and an outer tube, which is suitable for guiding a propellent gas; and a base body, which is tightly connected to the two tubes of the double jacketed tube by a connection element and which has connecting orifices which form a connection between an interior of the inner tube and in each case one connection point connected to the internal guide element of the at least two individual injectors, and connecting passages which form a connection between a region between the inner tube and the outer tube of the double jacketed tube and in each case one connection point connected to the external guide element, which surrounds the internal guide element of the at least two individual injectors, wherein the base body and the at least two individual injectors are arranged in such a way that a mixture of carrier gas and solid particles or liquid droplets which is supplied through the inner tube and a propellent gas which is supplied through the region between the inner tube and the outer tube lead to a turbulent flow mixture of propellent gas, carrier gas and solid particles or liquid droplets and to the turbulent flow mixture formed being distributed radially and uniformly.

2. An injector as claimed in claim 1, wherein the at least two individual injectors each have a pressure chamber, and wherein the connection element has bores which are arranged in the form of a ring for conveying and uniformly distributing the propellent gas, which bores are dimensioned in such a way that the pressure drop when flowing through is lower by a multiple than when flowing into the pressure chamber of the at least two individual injectors.

3. An injector as claimed in claim 1, wherein an annular distributor chamber is present in the base body, which chamber is connected to the region between the inner tube and the outer tube of the double jacketed tube and from which chamber the connecting passages lead to in each case one connection point for an external guide element of the at least two individual injectors.

4. An injector as claimed in claim 1, wherein three to eight individual injectors are arranged in a regular polygon and connected to the base body.

5. An injector as claimed in claim 1, wherein the at least two individual injectors are configured as two-substance annular injectors.

6. An injector as claimed in claim 1, wherein the external guide element of the at least two individual injectors is arranged in such a way that the propellant gas, on coming into contact with the mixture of carrier gas and solid particles or liquid droplets, has a flow component which is tangential with respect to an axis of the individual injector in question.

7. An injector as claimed in claim 1, wherein the at least two individual injectors are connected in groups to a plurality of injector levels on the base body.

8. An injector as claimed in claim 1, wherein a central spraying direction of the at least two individual injectors has only a radial and an axial component with respect to an axis of the double jacketed tube.

9. An injector as claimed in claim 1, wherein a central spraying direction of the at least two individual injectors has a component which is tangential with respect to an axis of the double jacketed tube.

* * * * *